US009593486B2

(12) United States Patent
Thompson

(10) Patent No.: US 9,593,486 B2
(45) Date of Patent: Mar. 14, 2017

(54) STRUCTURAL COMPONENT

(71) Applicant: Kenneth R. Thompson, Chuluota, FL (US)

(72) Inventor: Kenneth R. Thompson, Chuluota, FL (US)

( * ) Notice: Subject to any disclaimer, the term of this patent is extended or adjusted under 35 U.S.C. 154(b) by 0 days.

(21) Appl. No.: 15/169,982

(22) Filed: Jun. 1, 2016

(65) Prior Publication Data

US 2016/0356044 A1 Dec. 8, 2016

Related U.S. Application Data

(60) Provisional application No. 62/171,268, filed on Jun. 5, 2015.

(51) Int. Cl.

| | |
|---|---|
| ***E04B 1/76*** | (2006.01) |
| ***E04C 3/12*** | (2006.01) |
| ***E04B 1/88*** | (2006.01) |

(52) U.S. Cl.

CPC ..... *E04C 3/122* (2013.01); *E04B 1/7604* (2013.01); *E04B 1/88* (2013.01); *E04C 3/127* (2013.01); *E04B 1/76* (2013.01)

(58) Field of Classification Search

CPC . E04B 1/76; E04B 1/7604; E04B 1/88; E04C 3/122; E04C 3/127

USPC ..... 52/407.4, 404.2, 404.5, 784.15, 794.1, 52/404.1, 376, 838, 220, 220.3, 220.8

See application file for complete search history.

(56) References Cited

U.S. PATENT DOCUMENTS 5,505,031 A * 4/1996 Heydon ..... B26D 3/006 52/241
5,609,006 A * 3/1997 Boyer ..... E04B 2/7457 52/309.7
6,161,361 A * 12/2000 Ehrenkrantz ..... E04C 3/291 52/834
6,412,249 B1 * 7/2002 Boyer ..... E04B 2/7457 52/481.1
6,457,293 B1 * 10/2002 Tsai ..... E04B 2/8658 52/481.1
7,568,318 B1 8/2009 Egan
(Continued)

FOREIGN PATENT DOCUMENTS

DE 3128134 A1 * 2/1983 ..... E04D 13/1618
GB 2197670 A 12/1986
(Continued)

OTHER PUBLICATIONS http://raycore.com/images/roofwallinfowr.pdf.

*Primary Examiner* — Babajide Demuren
(74) *Attorney, Agent, or Firm* — Mark Malek; Kelly G. Swartz; Widerman Malek, PL

(57) ABSTRACT

A structural component for use in building construction including a first and second support material member, an insulating material, and a first securing member. The first support material member may have a first length, a first side, and an opposing second side. The second support material member may have a second length, a first side, and an opposing second side. The second support material member may oppose the first support material member. The insulating material may be disposed between the first support material member and the second support material member. The first securing member may be adapted to secure the first support material member to the second support material member.

14 Claims, 5 Drawing Sheets

(56) References Cited

U.S. PATENT DOCUMENTS

| | | | | |
|---|---|---|---|---|
| 2005/0204699 | A1* | 9/2005 | Rue | E04C 2/22 52/794.1 |
| 2011/0036046 | A1* | 2/2011 | Henriquez | E04B 1/161 52/764 |

FOREIGN PATENT DOCUMENTS

| | | | | |
|---|---|---|---|---|
| GB | 2197670 | A * | 5/1988 | E04B 1/80 |
| GB | 2259723 | A * | 3/1993 | E04C 3/29 |
| WO | WO 93/14278 | A1 | 7/1993 | |
| WO | WO9314278 | A1 * | 7/1993 | |

* cited by examiner

STRUCTURAL COMPONENT

RELATED APPLICATIONS

This application claims the benefit under 35 U.S.C. §119 (e) of U.S. Provisional Patent Application Ser. No. 62/171,268 titled Structural Component, filed on Jun. 5, 2015, the entire contents of each of which are incorporated herein by reference except to the extent that any disclosure therein conflicts with any disclosure here.

FIELD OF THE INVENTION

The present invention relates to apparatus and methods for building construction components. Specifically, the present invention relates to a composite, insulated structural component comprised of a structural member and insulating material.

BACKGROUND

Many structures are built utilizing wood framing components often referred to as studs. Structures built utilizing wooden studs are often insulated by placing insulation in the cavities between the studs. This creates a structure lacking a continuous thermal barrier as there is no insulation incorporated into known studs.

Other attempts to address this problem include structural insulated panels that sandwich foam between two layers of structural board and adding foam insulation to the outside of a framed wall. However, these solutions are significantly more expensive than standard building materials.

Accordingly, there exists a need to provide a structural component, or a stud, that addresses the deficiencies mentioned above.

SUMMARY OF THE INVENTION

With the above in mind, embodiments of the present invention are related to a structural component for use in building construction, which may include a first support material member, a second support material member, an insulating material, and a first securing member. The first support material member may have a first length, a first side, and an opposing second side. The second support material member may have a second length, a first side, and an opposing second side. The second support material member may oppose the first support material member. The insulating material may be disposed between the first support material member and the second support material member. The first securing member may be adapted to secure the first support material member to the second support material member.

The insulating material may extend along the entirety of the first length and the second length. The structural component may include a routing passageway located through the entirety of a thickness of the insulating material. The structural component may include a removable insert removably carried by the routing passageway.

The structural component may include a first connecting aperture extending through the first length from the first side to the second side and a second connecting aperture extending through the second length from the first side to the second side. The first securing member may include a first dowel located at least partially within both the first connecting aperture and the second connecting aperture.

The structural component may include a third connecting aperture extending from the first side to the second side of the first length of the first support material member and located a first vertical distance from the first connecting aperture. A fourth connecting aperture may extend from the first side to the second side of the second length of the second support material member and may be located a second vertical distance from the second connecting aperture. A second dowel may be adapted to secure the first structural member to the second structural member and may be located at least partially within both the third connecting aperture and the fourth connecting aperture. The second vertical distance may be greater than the first vertical distance.

The structural component may include a retaining dowel adapted to be carried by a retaining member aperture and the first dowel. The retaining member aperture may extend between a surface of the first support material member and the first connecting aperture. The first dowel may have a dowel receiving aperture adapted to carry the retaining dowel.

The second connecting aperture may be located in vertical alignment with the first connecting aperture. The fourth connecting aperture may be located in vertical alignment with the third connecting aperture. The first connecting aperture may be located in horizontal misalignment with the third connecting aperture. The second connecting aperture may be located in horizontal misalignment with the fourth connecting aperture.

The first securing member may include a dowel, and the first length may be equal to the second length. Further, the first support material member may have a first edge and a second edge. Similarly, the second support material member may have a first edge and a second edge. The first securing member may be adapted to secure the first edge of the first support material member to the first edge of the second support material member.

The first support material member may include a first channel adapted to receive the insulating material and the second support material member may include a second channel adapted to receive the insulating material.

The structural component may include a second securing member adapted to secure a second edge of the first support material member to an opposing second edge of the second support material member. The second securing member may be adapted to secure a first edge of the first support material member to an opposing first edge of the second support material member.

DETAILED DESCRIPTION OF THE INVENTION

Figure 1:
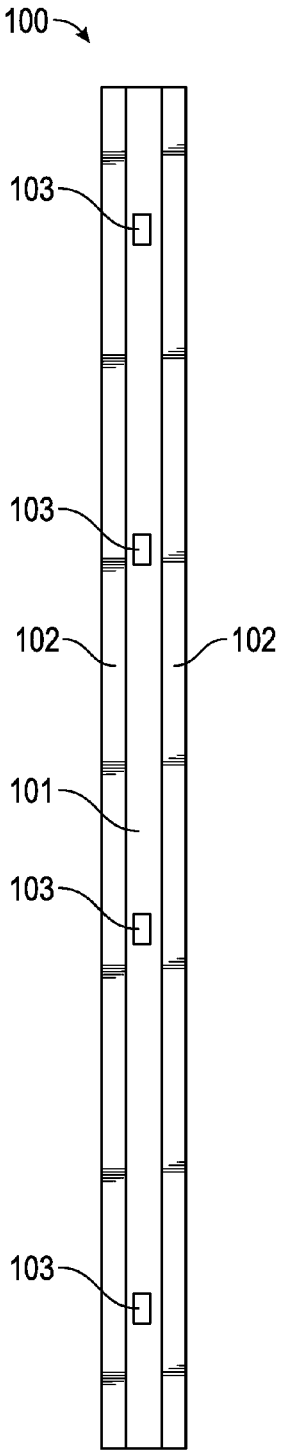
FIG. 1 is a front elevation view of a structural component according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a structural member 100 constructed by sandwiching an insulating material 101 between two support material members 102. More specifically, the structural member 100 according to embodiments of the present invention provides a continuous thermal barrier by incorporating an insulating material into the structural member 100, which may be used as a stud member in building construction applications.

The inventive stud is a structural member 100 that may be used similarly to known studs, with the advantage of adding insulating material 101 to the structural member. The similarities between existing studs and the structural member 100 are advantageous as they increase the rate of acceptance and utilization of the structural member 100. The structural member 100 may be adapted and substituted for structural building components, including, but not limited to, joists, rafters, headers, sills, or the like. The structural component 100 may have different dimensions and relative geometry based on its intended structural use.

An additional benefit of the structural member 100, according to embodiments of the present invention, is decreased sound transmission. By incorporating an insulating material 101 into the structural member 100, less sound may be transmitted through walls built with the structural component 100 because the insulating material 101 may serve as a sound dampener as well as a thermal barrier.

Yet another benefit of the structural member 100 according to embodiments of the present invention is the incorporation of routing passageways 103 built-in to the insulating material 101. The routing passageways 103 may be apertures adapted to allow wire, conduit, plumbing lines, and other types of lines that may be understood by the skilled artisan, to pass through the structural member 100 while eliminating the time consuming step of marking and drilling holes in conventional wood studs. Each routing passageway 103 may extend through the entirety of a thickness of the insulating material 101 from one side of the insulating material 101 to an opposing side. Each routing passageway 103 may carry a removable insert 118. The removable inserts 118 may be removably carried by and contained entirely within the routing passageway 103 located within the insulating material 101. The removable insert 118 may fill the entirety of the routing passageway 103. The removable insert 118 may be secured to the insulating material 101 with a perforated connection, allowing the removable insert 118 to be disengaged from the insulating material 101 along the perforations with minimal effort or tools. The removable insert 118 may be constructed from the same material as the insulating material 101. The removable insert 118 may be constructed by creating perforations within the insulating material 101.

The support material member 102 may be solid wood or may be constructed from wood. In some embodiments, the support material member 102 may be an engineered material, including, but not limited to, laminated veneer lumber (LVL). The support material member 102 used in a single structural component 100 may be constructed from metal or composite material. The two support material members 102 used to construct a single structural component 100 may be made of different materials. Each support material member 102 may be made of non-uniform materials. Each support material member 102 may have a length, a first side, and a second side. The length of each support material member 102 may extend from a first end to a distal second end of the support material member 102. The first side and second side of the support material member 102 may run along the entirety of the length of the support material member 102 and may oppose one another along that length. The two support material members 102 may have lengths equal or non-equal to one another. The support material member 102 may be a rectangular prism, wherein the first side is an inside face and the second side is the opposing outside face. A front face extending between the first and second sides may oppose a back face that also extends between the first and second sides. The front, back, inside, and outside faces may extend the length of the prism. The length of the support material member 102 may be significantly longer than the width of the inside, outside, front, or back face.

The insulating material 101 may be foam insulation. The foam may be open cell, closed cell, or a combination of same. It may be dense, loose, or a combination of same. In one embodiment, the insulating material 101 may be a solid, rigid foam insulation. The insulating material 101 may be a rectangular prism or essentially a rectangular prism with a left outside face opposing a right outside face. A front face extending between the left and right outside faces may oppose a back face that also extends between the left and right outside faces. The front, back, left outside, and right outside faces may extend the length of the prism. The length of the insulating material 101 may be significantly longer than the width of the front, back, left outside, or right outside face. The insulating material 101 may have a length equal to the length of one or both support material members 102. The insulating material 101 may be located between a first support material member 102 and second support material member 102. In such a configuration, the insulating material 101 may extend along an entirety of the first length of the first support material member 102 and a second length of the second support material member 102. In such an embodiment, the first and second lengths may be, but are not required to be, equal to one another.

The first sides of each of the support material members 102 may be dimensioned equal to the left and right outside faces of the insulating material 101, respectively. The first side of a first support material member 102 may be aligned with and secured to the right outside face of the insulating material 101. The first side of the second support material member 102 may be aligned with and secured to the left outside face of the insulating material 101 and may oppose the first support material member 102. The support material members 102 may be secured to the insulating material 101 and to one another using a securing member 108, including, but not limited to glue, straps, dowels 104, metal connectors, or any combination of these.

The support material member 102 may be secured to the insulating material 101 using an adhesive. In combination with an adhesive, or alone, one or more securing members 108, which may include, but are not limited to, dowels 104, may be utilized to improve structural integrity of the structural member 100. Wooden dowels 104 may be used rather than metal nails to eliminate potential concerns regarding the use of metal nails in the structural member 100. Use of wooden dowels 104, or other wooden securing members 108, may be particularly desirable when the support material members 102 are also constructed from wood. The use of wood throughout the structural component 100 may aid in allowing those skilled in the art to work with the structural component 100 in conventional ways, including, but not limited to, drilling holes through or hammering nails into one or more portions of the structural component 100. By way of example, and not as a limitation, the dowels 104 may be made from wood, carbon fiber, metal, or the like. Glue may be applied to abutting faces of the insulating material 101 and respective support material members 102. These faces may be aligned to one another and further secured to one another using one or more securing members 108, which may include, but are not limited to, dowels 104, straps, metal welds, elongate metal members, or a combination of these. In some embodiments, the securing member 108, which may be straps or dowels 104, may be removed after the glue has cured. In other embodiments, the straps, dowels 104, or other securing members 108 may remain installed.

When dowels 104 are incorporated into the structural member 100, one or more dowel 104 may be encircled by, or at least partially carried by, the insulating material 101 with a first end of the dowel 104 carried by one support material member 102 and a second, opposing end of the dowel 104 carried by the opposing support material member 102. In one embodiment, one or more connecting apertures 105 may extend through the length of the support material member 102 from the first side to the second side. In such an embodiment, the connecting aperture 105 may be adapted to carry a dowel 104. The connecting aperture 105 may be sized to secure a dowel 104 with a friction fit. In such an embodiment, a first connecting aperture 105 may extend through the first length of a first support material member 102 from the first side to the second side. A second connecting aperture 105 may extend through the second length of a second support material member 102 from the first side to the second side. A single dowel 104 may be at least partially located within and carried by the first connecting aperture 105, extend through the insulating material 101 and be at least partially located within and carried by the second connecting aperture 105. Each connecting aperture 105 may extend through the support material member 102 length from the first side to the second side in a plane orthogonal to the plane of the length of the support material member 102. In such an embodiment, the connecting aperture 105 would be at the same height on both the first and second sides of the support material member 102. In such an embodiment, the connecting aperture 102 opening on the first side of the support material member 102 is in horizontal alignment with the same connecting aperture 102 opening on the second side of the support material member 102. In other embodiments, one or more connection apertures 105 may extend through the support material member 102 length from the first side to the second side in a plane that is both non-orthogonal and non-parallel to the plane of the length of the support material member 102. In such an embodiment, the connecting aperture 102 would be at different heights on the first side and second side of the support material member 102. In such an embodiment, the connecting aperture 102 opening on the first side of the support material member 102 is in horizontal misalignment with the connecting aperture 102 opening on the second side of the support material member 102.

In other embodiments, a dowel 104 may secure only a single piece of support material member 102 to the insulating material 101. Each dowel 104 may fit into a connecting aperture 105 disposed within at least one of the support material members 102 and the insulating material 101. Connecting aperture 105 openings disposed on the support material member 102 may align with connecting apertures 105 openings disposed on the insulating material 101. Connecting apertures 105 may extend the entire width of the support material member 102 from the first side to the second side or the connecting apertures 105 may begin at a first side of the support material member 102, proximate the insulating material 101, and terminate before extending through the second side of the support material member 102, distal the insulating material 101. Connecting apertures 105 may extend the entire width of the insulating material 101 from the left outside face to the right outside face or the connecting apertures 105 may begin at the left or right outside face and terminate before extending through the insulating material 101 to the opposing face. One or more dowels 104 may be used in each structural member 100. In some embodiments, a plurality of dowels 104 may be evenly, unevenly, or irregularly spaced along the length of the structural member 100.

In some embodiments utilizing dowels 104, the dowels 104 may be inserted into the insulating material 101 or support material member 102 at an angle rather than orthogonally to the side of the material into which the dowel 104 is inserted. In an embodiment without an orthogonal insertion of the dowel 104, the diagonal insertion of the dowel 104 may increase the structural integrity of the structural member 100. The dowels 104 within a structural member 100 may be retained at different angles, and may have different diameters. The dowels 104 within a structural member 100 may have different diameters, lengths, or the like. The dowels 104 within a structural member 100 may be made of different materials.

Figure 2:
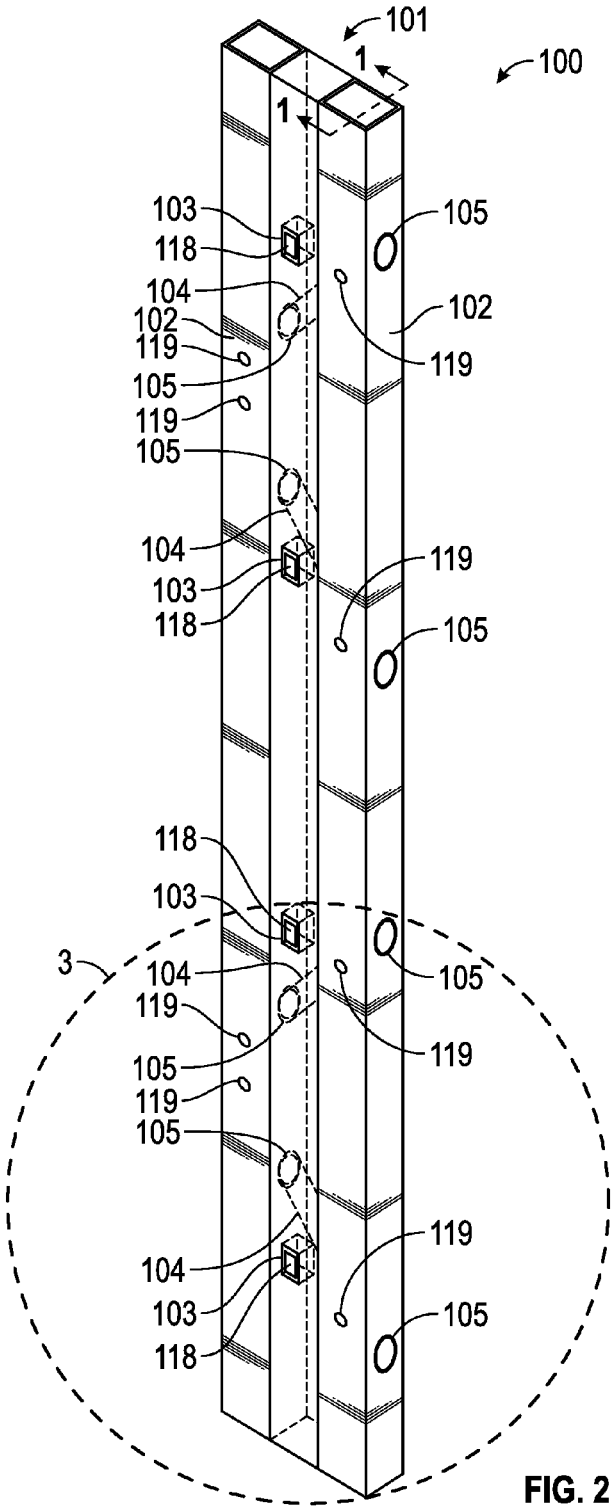
FIG. 2 is a side perspective view of the structural member depicted in FIG. 1.
Figure 3:
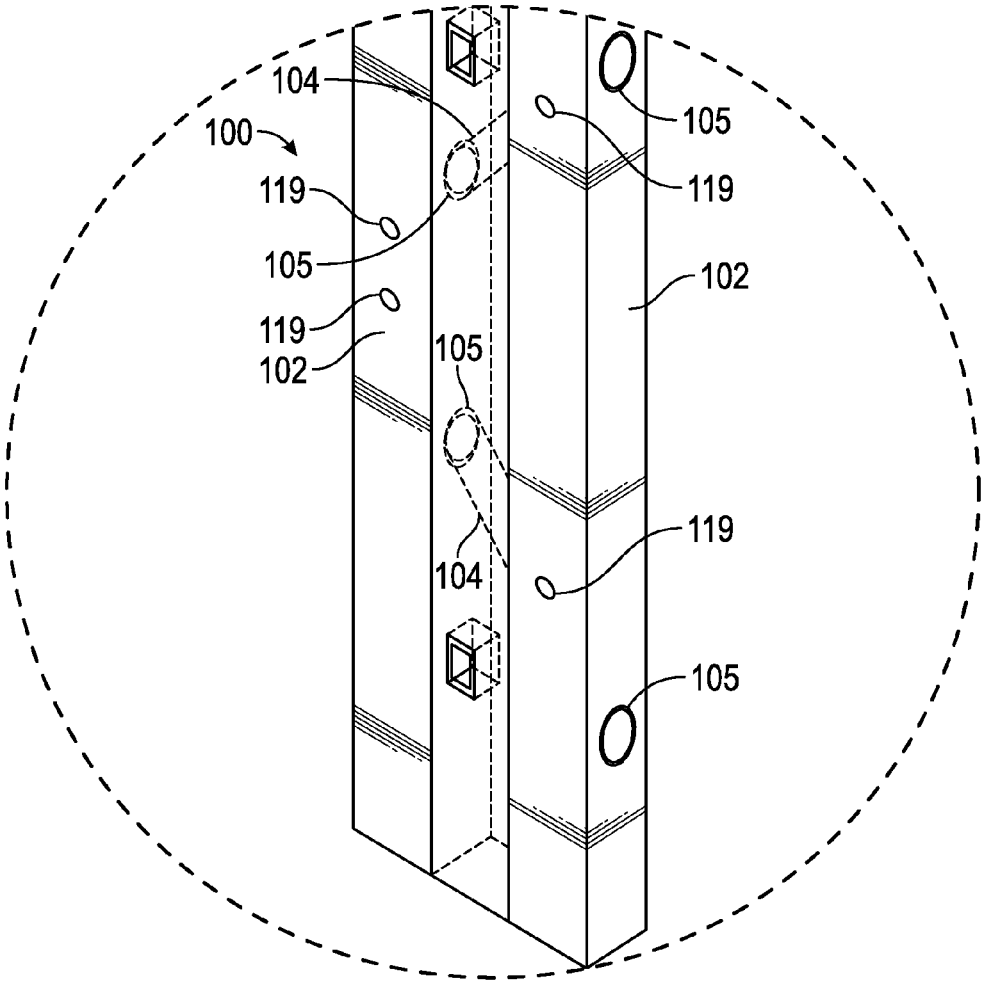
FIG. 3 is a detailed perspective view of the section of the structural member labeled 3 in FIG. 2.
Figure 4:
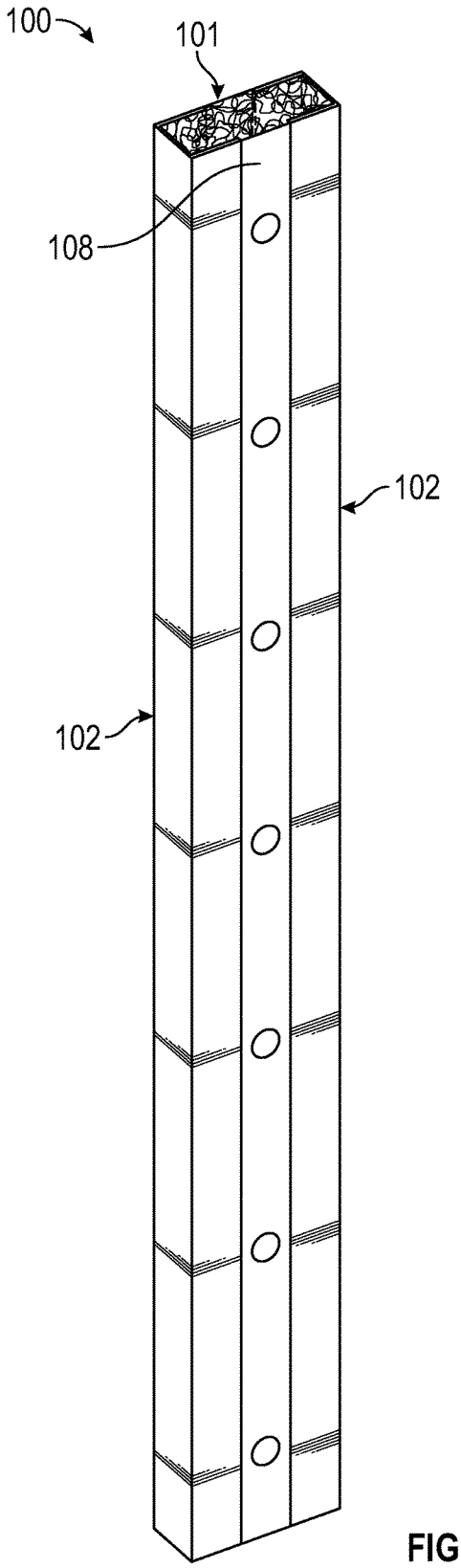
FIG. 4 is a front perspective view of the structural component according to another embodiment of the present invention.
Figure 5:
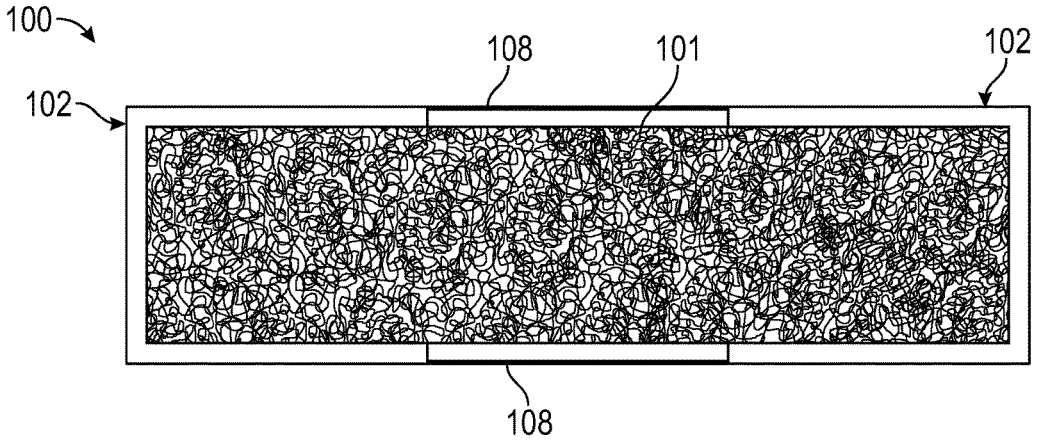
FIG. 5 is a top plan view of the structural component depicted in FIG. 4.

As shown in FIGS. 2 and 3, different support material members 102 within a single structural member 100 may have connecting apertures 105 positioned at different locations. These connecting apertures 105 may align with dowels 104 inserted through each support material member 102 in the structural member 100.

In one embodiment, more than one connecting aperture 105 may be located in a first support material member 102. The connecting apertures 105 within a single support material member 102 may be located a vertical distance from one another along the length of the support material member 102. Each connecting aperture 105 located on a support material member 102 may have a corresponding connecting aperture 105 on an opposing support material member 102. Corresponding connecting apertures 105 may be configured and adapted to retain opposing ends of a single dowel 104 extending between and carried by both opposing support material members 102. The dowel 104 may be adapted to secure the opposing support material members 102 to one another. The vertical distance between two connecting apertures 105 on a first support material member 102 may be less than the vertical distance between two connecting apertures 105 on a second support material, and each may correspond to one of the connecting apertures 105 on the first support material member. Two connecting apertures 105 located on a single support material member 102 may be centered on a single plane extending parallel to the length of the support material member. In such a configuration, the connecting apertures 105 are in vertical alignment. Such an arrangement is depicted in FIG. 2 and may create a diagonal configuration of one or more dowel 104.

The connecting aperture 105 may be defined by walls surrounding the connecting aperture 105. One or more retaining member apertures 119 may be located along a wall defining the connecting aperture 104 and extend through the support material member 102 to an exterior surface of the support material member 102. The retaining member aperture 119 may extend between the wall defining the connecting aperture 105 and a front face or back face of the support material member 102. The retaining member aperture 119 may extend between the wall defining the connecting aperture 105 and a first side or second side of the support material member 102. The retaining member aperture 119 may be adapted to carry a retaining dowel 120. The dowel 104 may have a dowel receiving aperture 121 located proximate an end of the dowel 104 and adapted to carry a retaining dowel 120. The dowel receiving aperture 121 may be positioned to align with a retaining member aperture 119 when the dowel 104 is positioned within the support material member 102. The retaining dowel 120 may be adapted to be carried by the retaining member aperture 119 and the dowel receiving aperture 121 located in the dowel 104.

The insulating material 101 may have one or more routing passageways 103 extending from the front face through to the back face. The routing passageways 103 may be configured to allow wiring and plumbing components to pass through the structural member 100. The routing passageways 103 may be evenly or irregularly spaced from one another or may be located at differing locations on the structural member 100.

One or more support material member 102 may be adapted to have a first edge 116 and a second edge 117. Both the first and second edge 116, 117 may be located on a portion of the support material member 102 proximate the insulating material 101 or proximate the opposing support material member 102. In one embodiment, both the first and second edge 116, 117 may be located on a first side of the support material member 102. The first edge 116 may be located proximate the intersection of a front or back face and the second edge may be located proximate the intersection of a front or back face. A securing member 108 may be adapted to secure the first edge 116 of a first support material member 102 with an opposing first or second edge 116, 117 of a second support material member 102.

Figure 6:
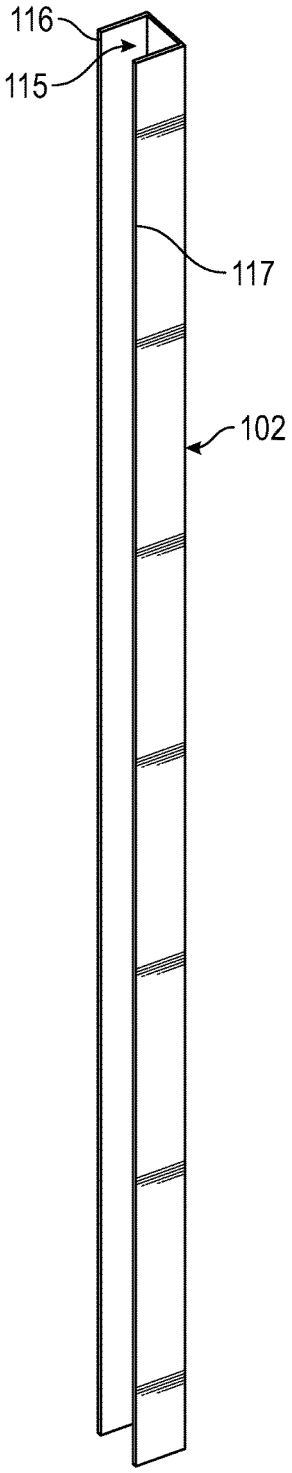
FIG. 6 is a front perspective view of an edge of the structural member depicted in FIG. 4.
Figure 7:
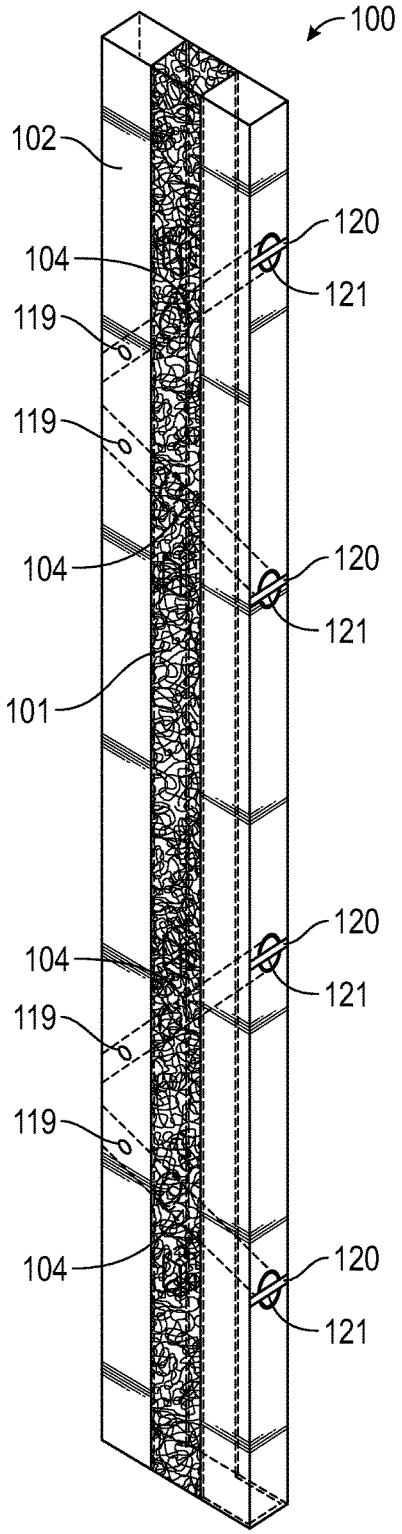
FIG. 7 is a partial perspective showing internal portions of the structural member taken through the 7-7 line in FIG. 2.

The support material member 102 may be constructed with a channel 115 located between two opposing portions of the support material member 102 that extend the entirety of the length of the support material member 102. The channel 115 may be a rectangular-shaped void extending the entirety of the length of the support material member 102 and defined on three sides by an interior surface of the support material member 102. The channel 115 may be defined by opposing front and back faces, which each extend the entirety of the length of the support material member 102. A side of each the front and back faces may secure to an outside face of the support material member 102. The opposing side of each the front and back faces, respectively, which is not secured to the outside face of the support material member 102 may have an edge extending the entirety of the length of the support material member 102. These edges may be the first and second edges. In such an embodiment, the support material member 102 may have a U-shaped configuration as depicted at least in FIG. 6. A securing member 108 may be adapted to secure to a first edge of a first support material member 102 and an opposing first or second edge of a second support material member 102, which opposes the first support material member 102.

The first and opposing second support material members 102 may be constructed from metal. The securing member 108 may be an elongate metal member adapted to be welded to edges on both the first and opposing second support material members 102.

The insulating material 101 may be adapted to be carried by a first channel 115 in a first support material member 102 and a second channel 115 in a second support material member 102. The channels 115 may be adapted to receive the insulating material 101 along an entirety of the length of the channels 115. A first securing member 108 may be adapted to secure to a first edge of the first support material member 102 and an opposing edge of the second support material member 102. The first securing member 108 may be welded to each the first and second support material members 102. The first securing member 108 may be adapted to extend along or parallel to a front face of the insulating material 101. A second securing member 108 may be adapted to secure to a second edge of the first support material member 102 and an opposing edge of the second support material member 102. The second securing member 108 may be welded to each the first and second support material members 102. The second securing member 108 may be adapted to extend along or parallel to a back face of the insulating material 101.

One or more support material members 102 may be formed from a monolithic piece of sheet metal. The metal may be stamped to form appropriate apertures and folded to create a channel 115.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the description of the invention. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

That which is claimed is:

1. A structural component for use in building construction comprising:

a first support material member having a first length, a first side, and an opposing second side;

a second support material member having a second length, a first side, and an opposing second side, wherein the second support material member opposes the first support material member;

an insulating material disposed between the first support material member and the second support material member;

a first securing member adapted to secure the first support material member to the second support material member;

a first connecting aperture extending through the first length from the first side to the second side;

a second connecting aperture extending through the second length from the first side to the second side;

a third connecting aperture extending from the first side to the second side of the first length of the first support material member and located a first vertical distance from the first connecting aperture;

a fourth connecting aperture extending from the first side to the second side of the second length of the second support material member and located a second vertical distance from the second connecting aperture; and a second dowel adapted to secure the first structural member to the second structural member and located at least partially within both the third connecting aperture and the fourth connecting aperture;

wherein the first securing member further comprises a first dowel located at least partially within both the first connecting aperture and the second connecting aperture; and wherein the second vertical distance is greater than the first vertical distance.

2. The structural component according to claim 1 wherein the insulating material extends along the entirety of the first length and the second length.

3. The structural component according to claim 1 further comprising:

a routing passageway located through the entirety of a thickness of the insulating material.

4. The structural component according to claim 3 further comprising:

a removable insert removably carried by the routing passageway.

5. The structural component according to claim 1 further comprising:

a retaining dowel adapted to be carried by a retaining member aperture and the first dowel;

wherein the retaining member aperture extends between a surface of the first support material member and the first connecting aperture; and wherein the first dowel has a dowel receiving aperture adapted to carry the retaining dowel.

6. The structural component according to claim 1 wherein the second connecting aperture is located in vertical alignment with the first connecting aperture;

wherein the fourth connecting aperture is located in vertical alignment with the third connecting aperture;

wherein the first connecting aperture is located in horizontal misalignment with the third connecting aperture; and wherein the second connecting aperture is located in horizontal misalignment with the fourth connecting aperture.

7. The structural component according to claim 1 wherein the first securing member comprises a dowel.

8. The structural component according to claim 1 wherein the first length is equal to the second length.

9. The structural component according to claim 1 wherein the first support material member has a first edge and a second edge;

wherein the second support material member has a first edge and a second edge;

wherein the first securing member is adapted to secure the first edge of the first support material member to the first edge of the second support material member.

10. The structural component according to claim 1 wherein the first support material member further comprises a first channel adapted to receive the insulating material and the second support material member further comprises a second channel adapted to receive the insulating material.

11. The structural component according to claim 10 further comprising:

a second securing member adapted to secure a second edge of the first support material member to an opposing second edge of the second support material member;

wherein the second securing member is adapted to secure a first edge of the first support material member to an opposing first edge of the second support material member.

12. A structural component comprising:

a first support material member having a first length and a first connecting aperture extending through the first length from a first side to an opposing second side;

a second support material member, opposing the first support material member, having a second length equal to the first length and a second connecting aperture extending through the second length from a first side to an opposing second side;

an insulating material disposed between the first support material member and the second support material member, wherein the insulating material extends along the entirety of the first length and the second length and has a routing passageway located through the entirety of a thickness of the insulating material;

a removable insert removable carried by the routing passageway; and a first dowel located at least partially within both the first connecting aperture and the second connecting aperture and adapted to secure the first structural member to the second structural member;

wherein the first support material member has a third connecting aperture extending through the first length from the first side to the second side and located a first vertical distance from the first connecting aperture;

wherein the second structural member has a fourth connecting aperture extending through the second length from the first side to the second side and located a second vertical distance from the second connecting aperture; and wherein the second vertical distance is greater than the first vertical distance.

13. The structural component according to claim 12 further comprising:

a retaining dowel adapted to be carried by a retaining member aperture and the first dowel;

wherein the retaining member aperture extends between a surface of the first support material member and the first connecting aperture; and wherein the first dowel has a dowel receiving aperture adapted to carry the retaining dowel.

14. The structural component according to claim 12 wherein the second connecting aperture is located in vertical alignment with the first connecting aperture;

wherein the fourth connecting aperture is located in vertical alignment with the third connecting aperture;

wherein the first connecting aperture is located in horizontal misalignment with the third connecting aperture; and wherein the second connecting aperture is located in horizontal misalignment with the fourth connecting aperture.

* * * * *